US007837501B2

(12) United States Patent
Youtsey

(10) Patent No.: US 7,837,501 B2
(45) Date of Patent: Nov. 23, 2010

(54) JUMPER SLEEVE FOR CONNECTING AND DISCONNECTING MALE F CONNECTOR TO AND FROM FEMALE F CONNECTOR

(75) Inventor: Timothy L. Youtsey, Scottsdale, AZ (US)

(73) Assignee: Phoenix Communications Technologies International, Gilbert, AZ (US)

( * ) Notice: Subject to any disclaimer, the term of this patent is extended or adjusted under 35 U.S.C. 154(b) by 0 days.

(21) Appl. No.: 12/382,307

(22) Filed: Mar. 13, 2009

(65) Prior Publication Data

US 2010/0233902 A1 Sep. 16, 2010

(51) Int. Cl.
*H01R 9/05* (2006.01)

(52) U.S. Cl. ..... 439/578; 439/445; 81/467

(58) Field of Classification Search ..... 439/445, 439/578; 81/467
See application file for complete search history.

(56) References Cited

U.S. PATENT DOCUMENTS 5,316,348 A * 5/1994 Franklin ..... 285/39
5,367,925 A * 11/1994 Gasparre ..... 81/121.1
5,857,711 A * 1/1999 Comin-DuMong et al. ... 285/38
6,817,272 B2 * 11/2004 Holland ..... 81/124.2
7,147,509 B1 * 12/2006 Burris et al. ..... 439/578
7,311,555 B1 * 12/2007 Burris et al. ..... 439/594
7,347,129 B1 * 3/2008 Youtsey ..... 81/467
7,500,874 B2 * 3/2009 Montena ..... 439/587
7,513,795 B1 * 4/2009 Shaw ..... 439/578

* cited by examiner

*Primary Examiner*—Truc T Nguyen
(74) *Attorney, Agent, or Firm*—David E. Rogers; Alex Starkovich; Squire, Sanders & Demspey L.L.P.

(57) ABSTRACT

A jumper sleeve for connecting and disconnecting a male F connector to and from a female F connector includes a wrench portion and a grip portion. The wrench portion has a leading end, a trailing end, and a hollow main body located between the leading end and the trailing end. The main body of the wrench portion internally has a hexagonally shaped portion corresponding to a shaped outer surface of a rotatable connecting ring of the male F connector. The grip portion has a rear end and a front end connected to the trailing end of the wrench portion, and has a plurality of circumferentially spaced externally convex sections, each of which has a radially inward key formed near the rear end thereof. The jumper sleeve provides greater mechanical advantage to produce sufficient torsion force, enabling easy installation and removal of the male F connector.

3 Claims, 3 Drawing Sheets

JUMPER SLEEVE FOR CONNECTING AND DISCONNECTING MALE F CONNECTOR TO AND FROM FEMALE F CONNECTOR

FIELD OF THE INVENTION

The present invention relates to a jumper sleeve installed on an outer side of a male F connector to facilitate easy connection of the male F connector to a female F connector.

BACKGROUND OF THE INVENTION

Screw-on F connectors are used on most RF coaxial cables to interconnect TV's, cable TV decoders, VCR/DVD's, hard disk digital recorders, satellite receivers, video games, TV signal distribution splitters and switches. Initially, F-type coaxial cables (an RG-6 or RG-59 type coaxial cable with a male F connector at each end), were used in simple installations to interconnect a TV to a cable box, VCR or video game, with ample room between the devices to interconnect the cables by hand.

F connectors have a standardized design, using a 7/16 inch hex connecting ring as the rotational connecting ring. The connecting ring has a relatively short 1/8 to 1/4 inch length available for finger contact. The internal threads on the connecting ring and matching F female are a 3/8-32 thread, requiring the male connector to be positioned exactly in-line with the female connector for successful thread engagement as rotation begins.

The male F connector in accordance with the prior art is designed to be screwed onto and off of the Female F connector using the fingers. The hex shaped connecting ring is provided for wrench tightening the connector after the male F connector is fully screwed onto the female F connector by the fingers (usually 4 turns).

There are currently two tools and methods for using the tools for tightening and loosening F connectors. A first tool is a standard open-end 7/16 inch wrench with a minimum shaft length of 4-6 inches. The use of this tool requires an unobstructed area for radial rotation of the tool around the axis of the F connectors once the threads on both male and female have been engaged. It is both the sharp bends formed in the semi-rigid coaxial F cables and the high density of the cables in current installations that have made the present means for installing, un-installing, tightening and loosening F connectors difficult and time consuming.

The second tool consists of a 7/16 inch hex connecting ring sleeve with a slot on the side to allow the socket to slide over an installed cable. The disadvantage of this tool is that the cable must be in a straight line with the male and female connectors being mated. This condition is no longer the typical installation situation; making this tool ineffective for its intended use. There is a need for a tool that can be used to connect and disconnect male F connectors in high cable density applications.

It is therefore tried by the inventor to develop a jumper sleeve with greater mechanical advantage for installing on an outer side of a male F connector, so that the male F connector can be more easily screwed to or loosened from a female F connector simply by gripping at the jumper sleeve with fingers and turning the male F connector.

SUMMARY OF THE INVENTION

A primary object of the present invention is to provide a jumper sleeve for fitting on an F-type coaxial cable structure, so as to enable easy connection of a male F connector on a coaxial cable to a female F connector on a television set, for example.

To achieve the above and other objects, the F-type coaxial cable structure has a male F connector and a coaxial cable connected to the male F connector; the male F connector has a rotatable connecting ring formed at a front end thereof; the coaxial cable is rearward extended from a rear end of the male F connector; and the connecting ring has a threaded inner surface and a hexagonal outer surface; and the jumper sleeve includes a wrench portion and a grip portion integrally connected to the wrench portion. The wrench portion is formed on an inner side with a hexagonally shaped portion for receiving the hexagonal outer surface of the connecting ring of the male F connector therein. The grip portion includes a plurality of circumferentially spaced externally convex sections, each of which has a radially inward key formed near a rear end thereof. An operator can grip at and turn the jumper sleeve to easily connect the male F connector to the female F connector or disconnect the male F connector from the female F connector with fingers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
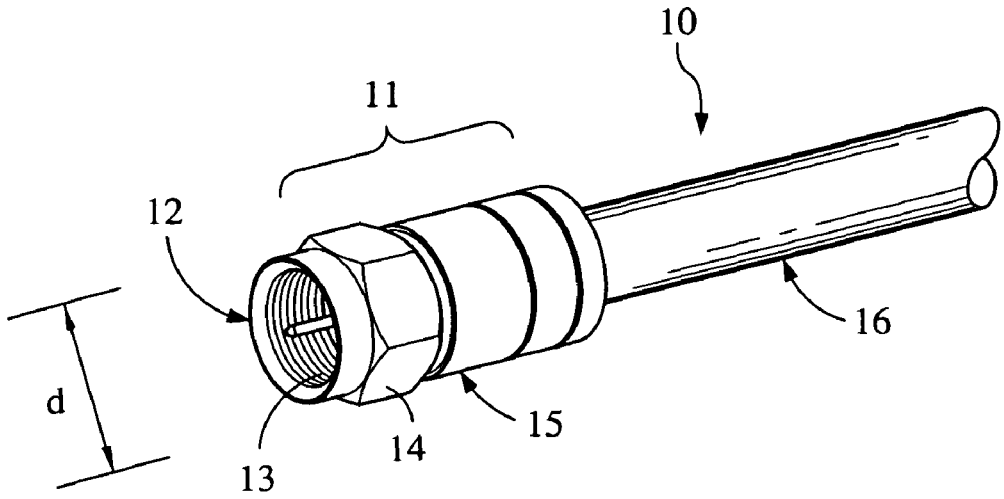
FIG.1 PRIOR ART
FIG. 1 is a perspective view of an F-type coaxial cable structure having a coaxial cable and a male F connector connected thereto.

Please refer to FIG. 1, which is a perspective view of an F-type coaxial cable structure 10 having a male F connector 11 and a coaxial cable 16 extended from a rear end of the male F connector 11. The male F connector 11 has a rotatable connecting ring 12 and a sleeve assembly 15. The connecting ring 12 has a threaded inner surface 13 and a hexagonally-shaped outer surface 14.

Figure 2:
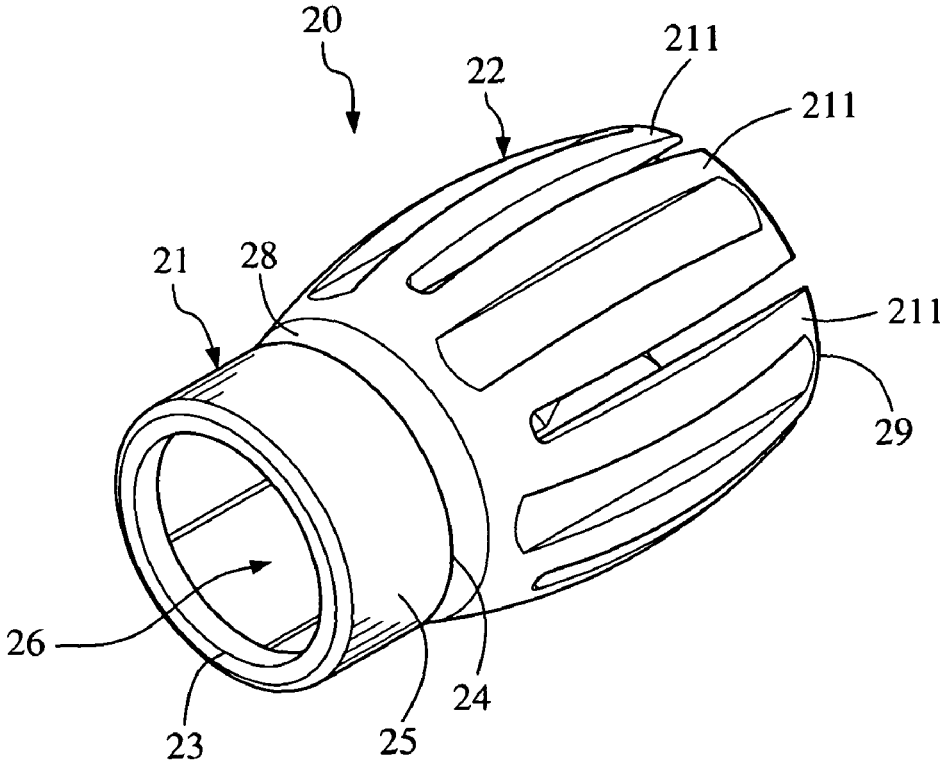
FIGS. 2, 3 and 4 are respectively a perspective view, a cutaway view, and a sectioned side view of a jumper sleeve according to a preferred embodiment of the present invention.
Figure 3:
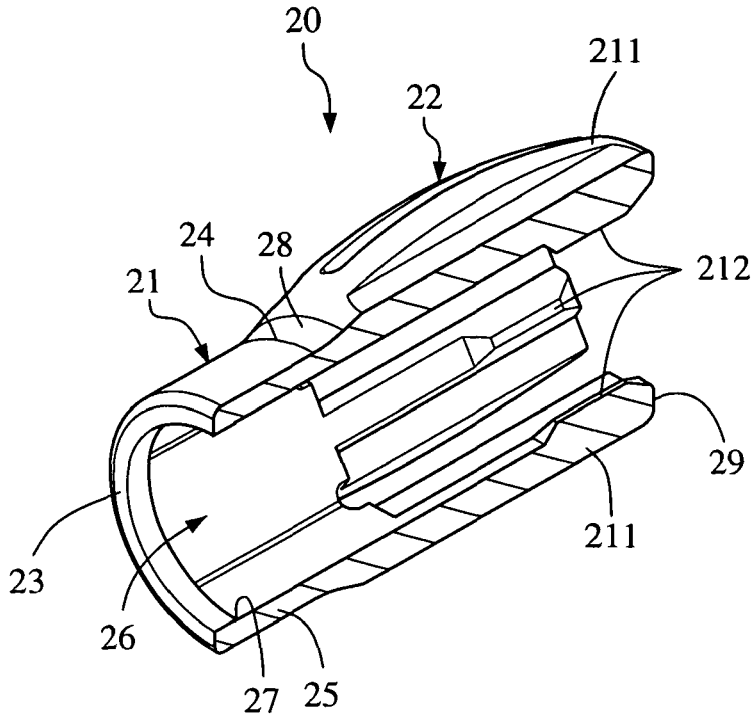
Figure 4:
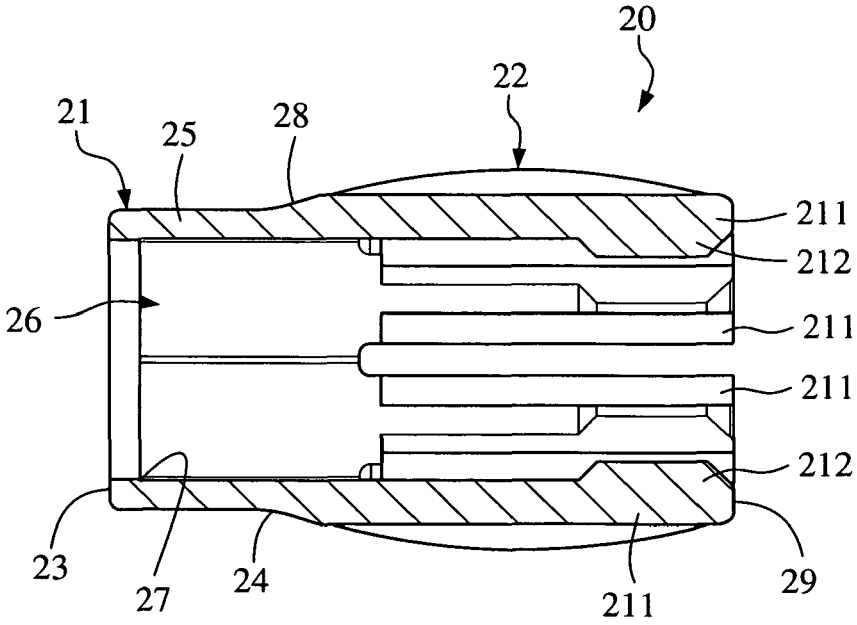

Please refer to FIGS. 2 to 4, which are respectively a perspective view, a cutaway view, and a sectioned side view of a jumper sleeve 20 according to a preferred embodiment of the present invention for facilitating easy connection or disconnection of a male F connector to or from a female F connector. The jumper sleeve 20 is a tubular member including a wrench portion 21 and a grip portion 22. The wrench portion 21 has a leading end 23, a trailing end 24, and a hollow main body 25 located between the leading end 23 and the trailing end 24. A hexagonally shaped portion 26 is formed in the main body 25 for receiving the hexagonal outer surface 14 of the connecting ring 12 of the male F connector 11. In addition, a stepped shoulder portion 27 is formed on an inner surface of the main body 25. When the male F connector 11 is fitted into the jumper sleeve 20 and moved forward along the jumper sleeve 20, the stepped shoulder portion 27 serves to prevent the hexagonal outer surface 14 of the connecting ring 12 from moving out of the leading end 23 of the wrench portion 21, as shown in FIG. 5B.

The grip portion 22 is a hollow element with a barrel-shaped configuration and having an annular front end 28 and a rear end 29. The front end 28 of the grip portion 22 is connected to the trailing end 24 of the wrench portion 21. A plurality of circumferentially spaced and externally convex sections 211 are axially extended between the front end 28 and the rear end 29 of the grip portion 22. In the illustrated embodiment, there are four equally spaced convex sections 211. Each of the convex sections 211 has a radially inward protruded inner key 212 formed near the rear end 29 of the grip portion 22. When the male F connector 11 is fully inserted into the jumper sleeve 20, the inner keys 212 serve to prevent the male F connector 11 from slipping out of the rear end 29 of the grip portion 22, as shown in FIG. 5B. Ribs or other anti-slip structures can be provided on the outer surface of the grip portion 22 to avoid slippage when an operator grips at the grip portion 22 to manually turn the male F connector 11.

Figure 5A:
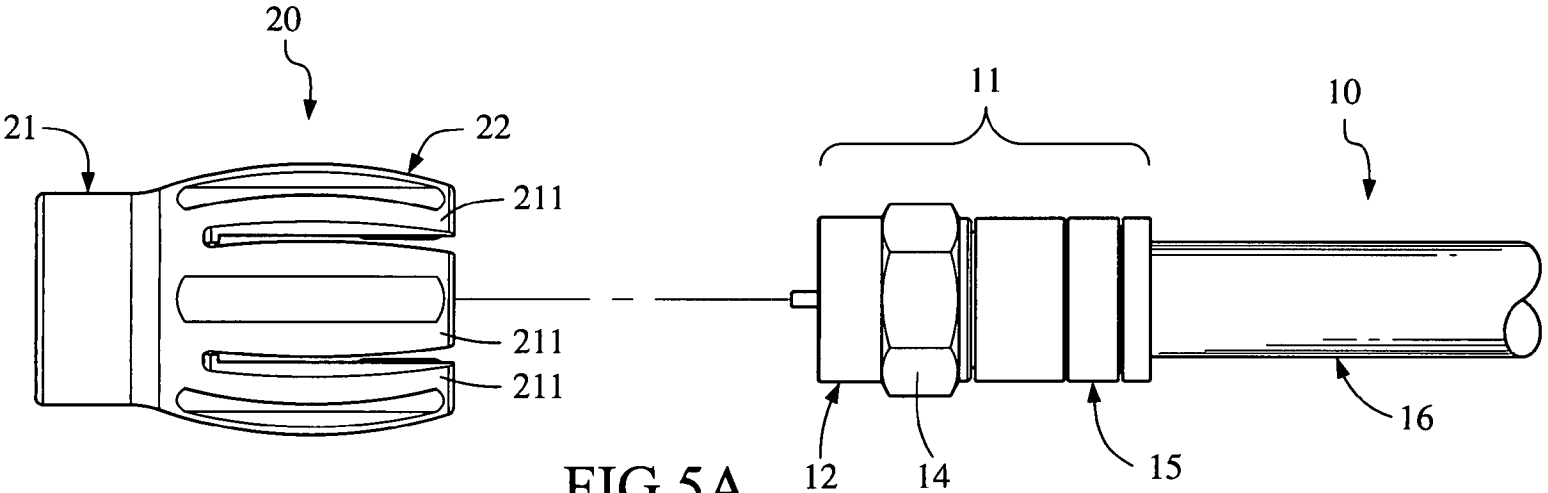
FIGS. 5A and 5B show the manner of installing the jumper sleeve of FIG. 2 onto a male F connector before connecting the male F connector to a female F connector.
Figure 5B:
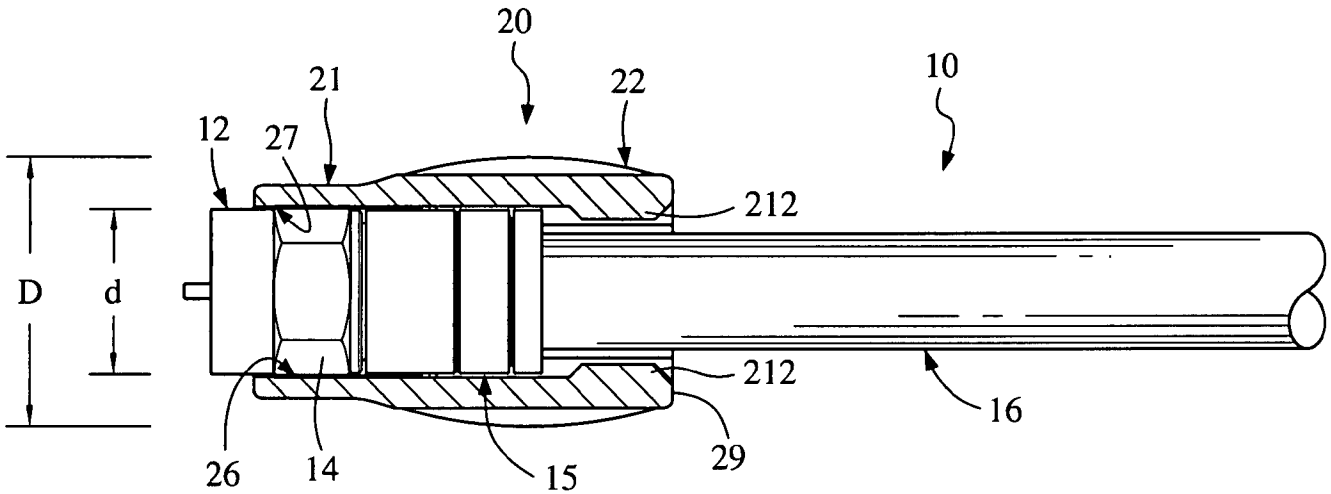

FIGS. 5A and 5B show the manner of installing the jumper sleeve 20 onto the male F connector 11 of the F-type coaxial cable structure 10. First, the male F connector 11 is inserted into the jumper sleeve 20 as shown in FIG. 5A, such that the hexagonal outer surface 14 of the connecting ring 12 is received in the hexagonally shaped portion 26 of the wrench portion 21, while the sleeve assembly 15 is received in the grip portion 22 as shown in FIG. 5B. An operator can hold the F-type coaxial cable structure 10 by gripping at the grip portion 22 with fingers, and turns the jumper sleeve 20 and accordingly the male F connector clockwise or counterclockwise, so as to connect the male F connector 11 to a female F connector on an electronic device, or disconnect the male F connector 11 from the female F connector.

Since the grip portion 22 has an outer diameter D much larger than an outer diameter d of the connecting ring 12, the jumper sleeve 20 can produce sufficient torsion force through its greater mechanical advantage, allowing the operator to effectively put the connecting ring 12 on the corresponding female F connector.

In conclusion, the jumper sleeve 20 of the present invention has greater mechanical advantage to produce sufficient torsion force, allowing an operator to continuously turn the jumper sleeve 20 and accordingly the connecting ring 12 during installing or removing the male F connector 11 onto or from the female F connector without using any tool. That is, the jumper sleeve 20 of the present invention allows an operator to more easily tighten or loosen the male F connector 11 with less effort.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A jumper sleeve being fitted on a F-type coaxial cable structure for connecting and disconnecting a male F connector of the F-type coaxial cable structure to and from a female F connector on an electronic device, the male F connector having a connecting ring rotatably provided at a front end thereof, and a coaxial cable being extended from a rear end of the male F connector, the connecting ring having a threaded inner surface and a shaped outer surface, the jumper sleeve comprising:

a wrench portion being a tubular element having a leading end, a trailing end, and a hollow main body located between the leading end and the trailing end; a shaped portion being formed in the main body for receiving the shaped outer surface of the connecting ring therein; and a grip portion being a hollow element having an annular front end and a rear end, the front end of the grip portion being connected to the trailing end of the wrench portion, and the grip portion having a plurality of circumferentially spaced externally convex sections;

wherein each of the externally convex sections of the grip portion has a radially inward protruded inner key formed near the rear end of the grip portion to prevent the male F connector from slipping out of the rear end of the grip portion;

wherein when the jumper sleeve is mounted to an assembled male F-Type cable structure and the male F-Type connector is fully inserted into the jumper sleeve, a gripping force may be applied to the grip portion to permanently affix the jumper sleeve to the male F-Type connector.

2. The jumper sleeve as claimed in claim 1, wherein the wrench portion is formed on an inner surface with a stepped shoulder portion, so as to prevent the shaped outer surface of the connecting ring from protruding beyond the wrench portion.

3. The jumper sleeve as claimed in claim 1, wherein the shaped portion in the main body of the wrench portion is a hexagonally shaped portion corresponding to the shaped outer surface of the connecting ring of the male F connector.

* * * * *